United States Patent [19]

Jones, Jr.

[11] 4,135,687

[45] Jan. 23, 1979

[54] STEERING AND STABILIZATION APPARATUS FOR AIRCRAFT

[76] Inventor: Allen Jones, Jr., 5028 Lauderdale Ave., Virginia Beach, Va. 23455

[21] Appl. No.: 822,227

[22] Filed: Aug. 5, 1977

Related U.S. Application Data

[63] Continuation-in-part of Ser. No. 661,626, Feb. 26, 1976, Pat. No. 4,040,373, which is a continuation-in-part of Ser. No. 579,896, May 22, 1975, abandoned, which is a continuation-in-part of Ser. No. 566,353, Apr. 9, 1975, Pat. No. 3,995,575, which is a continuation-in-part of Ser. No. 279,714, Aug. 10, 1972, Pat. No. 3,881,438.

[51] Int. Cl.[2] ..... B64C 5/10; B64C 9/00

[52] U.S. Cl. ..... 244/90 R; 244/91

[58] Field of Search ..... 114/126, 272–274, 114/280–283; 244/48, 87, 88, 90 R, 91, 162

[56] References Cited

U.S. PATENT DOCUMENTS

| | | | |
|---|---|---|---|
| 2,846,165 | 8/1958 | Axelson | 244/90 R |
| 3,247,820 | 4/1966 | White | 114/280 |
| 4,040,373 | 8/1977 | Jones, Jr. | 114/126 |

FOREIGN PATENT DOCUMENTS

| | | | |
|---|---|---|---|
| 545359 | 6/1956 | Italy | 244/90 R |
| 814173 | 6/1959 | United Kingdom | 114/280 |
| 1039592 | 8/1966 | United Kingdom | 114/126 |
| 1201021 | 8/1970 | United Kingdom | 114/283 |

*Primary Examiner*—Stephen G. Kunin

*Attorney, Agent, or Firm*—J. Maxwell Carson, Jr.

[57] ABSTRACT

Vane members are movably mounted on the hulls of watercraft to serve steering and stabilization functions. Several embodiments are provided, some of which rotate between extended and shielded positions, others of which fold to vary the angle at which they extend from their associated hull, and still others of which both rotate and fold to facilitate storage alongside planar hull portions. Both shaft and surface bearing vane mounting systems are described. In preferred practice, the vanes are used on hydrofoil-carrying semi-displacement ships, and the provision of stowably mounted hydrofoils, planing surfaces, and wave form generators on such ships is also provided. Such vane members are also provided on vehicles operable in a fluid medium, such as torpedos operable completely submerged in water, and aerial vehicles such as missiles and aircraft of both the rotary wing and fixed wing types, to similarly serve steering and stabilization functions.

4 Claims, 45 Drawing Figures

STEERING AND STABILIZATION APPARATUS FOR AIRCRAFT

CROSS REFERENCE TO RELATED APPLICATIONS

The present application is a continuation-in-part of application Ser. No. 661,626, filed Feb. 26, 1976, now U.S. Pat. No. 4,040,373, issued Aug. 9, 1977, which is a continuation-in-part of application Ser. No. 579,896, filed May 22, 1975, now abandoned, which was a continuation-in-part of application Ser. No. 566,353, filed Apr. 9, 1975, now U.S. Pat. No. 3,995,575, issued Dec. 7, 1976, which in turn was a continuation-in-part of application Ser. No. 279,714, filed Aug. 10, 1972, now U.S. Pat. No. 3,881,438, issued May 6, 1975.

BACKGROUND OF THE INVENTION

1. Field of the Invention

The present invention relates to steering and stabilization apparatus for vessels, as well as vehicles operable in a fluid medium.

2. Prior Art

Proposals have been made to equip vessels of various configurations with steering apparatus suited to guide ship movement in both shallow and deep waters. Most such proposals have included one or more rudders pivoted about substantially vertical axes and positioned toward the rear of the vessel's hull.

Other proposals have been made to equip vessels with stabilization apparatus such as port and starboard surface piercing hydrofoils. If the vessel rolls toward one side or the other, the foils tend to correct the roll inasmuch as the exposed surface area of one foil is increased while the exposed surface area of the other foil is decreased. One proposal has been made to pivotally mount lift-producing, surface-piercing hydrofoils on a surface watercraft for movement about substantially horizontal axes to provide lateral stabilization at controllable bank angles.

A problem with prior steering and stabilization proposals has been that the rudders or foils they employ are not movable between sheltered and extended positions. To the extent that some rudders or foils have been mounted for movement to retracted or storage positions, such structures have not been operable in their retracted or storage positions. An additional problem with prior steering apparatus proposals is that they provide no "heeling" function, i.e., they do not assist in banking the ship as is required for relatively high speed maneuvers.

As far as vehicles operable in a fluid medium, such as fixed wing airplanes, are concerned, steering thereof has been obtained by the provision of a rudder mounted on a rearwardly positioned vertical stabilizer, while banking thereof during turns has been obtained by the provision of ailerons carried by the wings thereof. Aerial missiles have been provided with vertical and horizontal surfaces extending outwardly from the body thereof carrying movable vane members operable to steer and stabilize the same.

The Parent Patents

The referenced Parent Patents describe semi-displacement ships provided with submerged hydrofoils to raise their hulls in the water when the ships are underway. The hulls are not raised out of the water during cruising, but rather are raised a sufficient amount to substantially reduce wetted surface area and attendant drag forces.

A significant feature of the described ships is the cross section of their hulls. The sides of each of the hulls have upper, lower, and intermediate portions. The upper portions are relatively widely spaced. The lower portions are relatively narrowly spaced. The intermediate portions form inclined transition surfaces between the upper and lower portions.

When the described ships are at rest in the water, the displacement water line is near the junctures of the upper and intermediate portions. At this time, a substantial portion of the hulls are submerged and the ships are wholly supported by displacement forces.

When the described ships are cruising, lift forces derived from the hydrofoils lift the hulls such that the cruising water line is near the junctures of the lower and intermediate portions. At this time, substantial portions of the hulls are still submerged and displacement forces still contribute significantly to the support of the ships; but the relatively large surface area of the inclined intermediate portions is now out of the water. The resulting decrease in wetted surface area substantially reduces drag and permits increased operating speeds with a savings in fuel consumption.

Raising a hull of the described type in the water by "X" linear units will reduce the wetted hull surface by "X" times the secant of the angle by which the sides are inclined from the vertical. By substantially confining the inclined portions of the sides to the region of the hull which rises out of the water, the angle of side inclination can be selected to maximize the amount of wetted surface area that will be removed from the water with each linear unit of rise of the hull.

A desirable angle of inclination of the intermediate side portions is within the range of 35°–55°. This range of angles provides the intermediate side portions with a sufficient angle of inclination to dissipate the impact of wave pounding, and yet provides a secant of within the approximate range of 1.2 to 1.7 which, as was previously explained, will effect a rapid reduction of the wetted hull surface as the ship gets underway.

The hydrofoils of the described ships are supported in the submerged keel sections of their hulls. The hydrofoils preferably do not protrude beyond the maximum width of the deck of the ships, thereby enabling the ships to use conventional docking facilities. The hydrofoils are preferably movably mounted so that the front portion of each foil can be elevated relative to its rear portion to increase lift, or lowered relative to its rear portion to decrease lift.

Another feature of the described ships lies in the positioning of the foils in groups so that the hydrofoils of each group can provide substantially a contiguous surface to raise the hull as the ships get underway. The adjacent foils of each group are arranged in close proximity to each other with the forward foils positioned higher than their adjacent rearward foils. By this arrangement, the foils can be rotated to a position of alignment wherein the adjacent foils provide continuous high-lift surfaces on each side of a ship to increase lift and decrease the amount of time needed to reach cruising speed and attitude.

It is estimated that the described ships can be used to transport cargo at approximately 20 knots on the same amount of fuel used by conventional displacement hull ships in attaining between 12 and 15 knots of speed. Estimates are that 30 knots of speed are attainable for a 20-knot fuel bill. Accordingly, greater economies are found in high-speed operation than are available to conventional ships.

The advantages of the described hull cross section accordingly include:

1. A deep-submergence hull is provided which does not raise the hull out of the water and accordingly does not subject the bottom of the hull to wave pounding.
2. A minimal wetted surface area is held in the water, thereby minimizing drag.
3. A stable cargo-supporting platform is provided by the deep-submergence hull which is subject to minimal pitch in choppy seas.
4. Since the submerged keel section is of relatively small cross section, it can easily be rigidly braced to withstand high impact loads.
5. The slim cross section of the submerged keel section permits the use of relatively long hydrofoils along opposite sides without causing these hydrofoils to extend beyond the maximum width of the cargo-carrying deck.
6. The hull cross section can be increased or decreased in scale to provide larger or smaller ships.

A problem first addressed by the latest of the Parent Patents, i.e., U.S. Pat. No. 4,040,373 issued Aug. 9, 1977 is that of providing a combination stabilization and steering system for the described ships. When the described ships are underway and the hydrofoils are operating to raise much of the ship's hulls out of the water, the ships may, at times, be relatively unstable. While the hydrofoils act as stabilizers and are rotatably mounted to function as roll controls, it has been found desirable, especially where such ships are to be used in heavy seas, to provide the described ships with additional stabilization means.

An additional problem first specifically addressed by the latest of the Parent Patents is that of "heeling," i.e., coordinating the banking of the described ships with turning to facilitate stable steering maneuvers. Still another problem first addressed by the latest of the Parent Patents is that of providing the described ships with an apparatus for operating the ships at controlled angles of yaw as may be required where substantial crosscurrents are encountered or where the ships carry unbalanced loads.

Such problems have been overcome by providing on the described ships, as disclosed in the latest of the Parent Patents, at least one pair of vane members rotatably mounted on opposite sides of submerged hull portions thereof operable to provide steering and heeling functions, as well as operable to raise and lower the described ships in the water.

SUMMARY OF THE INVENTION

The present invention overcomes certain of the drawbacks of the prior art and provides a novel and improved steering and stabilization apparatus for vessels, as well as vehicles operable in a fluid medium.

While apparatus embodying the present invention is preferably used on such ships as are described in the Parent Patents, such apparatus can be used to advantage on vehicles operable in a fluid medium, such as aircraft, missiles, and torpedos. Where apparatus embodying the present invention is used on such ships as are described in the Parent Patents, several especially advantageous results obtain as will be described.

In accordance with one feature of the present invention, vane members are rotatably mounted in pairs on opposite sides of submerged hull portions. In the preferred embodiment, the vane members have substantially planar portions that flare obliquely outwardly relative to their supporting hull portions. When the vane members on opposite sides of a ship's hull are counter-rotated to selectively expose their upper and lower surfaces to the flow of water moving alongside the ship's hull, they serve steering and heeling functions. When the vane members on opposite sides of a ship's hull are rotated in unison in the same direction, they can act in the manner of diving planes to raise and lower the ship. Vane members of this type find particular use on submarines.

In accordance with another feature of the invention, a pair of vane members are interconnected by a mounting structure and are mounted on the underside of a ship to replace or augment conventional rudders. In this embodiment, the vane members extend obliquely to the ship's underside and are capable of serving steering and heeling functions. Interconnected vane members of this type are preferably located in surrounding relationship to the ship's propellor, or rearwardly thereof to operate in the wash of the propellor.

In another embodiment, vane members are hingedly connected to a rotatable support for folding between extended and storage positions. The vane members are preferably configured such that when they are in storage positions, the drag forces encurred by the vane members are balanced about the axes of rotation of the vane members. In other embodiments, an axial balance of drag forces is achieved at selected angles of extension of the vane members and the vane members are normally operated at these "balance angles."

A feature of the preferred vane embodiments is that they are rotatable between sheltered and extended positions. In their sheltered positions the vane members preferably overlie or lie alongside hull portions that extend obliquely to the vane-mounting hull portions of the described ships.

One drive mechanism for movably supporting and positioning vane members includes vane mounting shafts which extend through the hull for rotating the vane members between their sheltered and extended positions. The drive system is also operable to counter-rotate the vane members once the vane members are in either of their extended or sheltered positions to provide steering and heeling functions. Other functions such as ship stabilization, bank control, braking and movement of the craft through water at a desired angle of yaw can be effected by proper relative positioning of the vane members by the drive mechanism.

A preferred drive mechanism for vane members carried by the described ships includes a disk-like vane mounting structure which is peripherally journaled by a large surface area, self-cleaning, tapered, water-lubricated bearing. Bearings of this type are commercially available for marine applications and are well suited to transmit forces efficiently between the mounting structure and the ship's hull.

In accordance with still another feature of the present invention, a pair of vane members are rotatably mounted on opposite sides of the body of a torpedo operable submerged in water or on opposite sides of the body of a missile operable in the atmosphere. Such vane members are mounted in recesses formed in the sides of the bodies of such vehicles to occupy sheltered positions in which they lie completely within the overall cross sectional outline of the bodies of such vehicles, permitting the same to be stored in a launcher carried by a ship or an aircraft having a tubular interior similar in outline, taken in cross section, to such overall cross sectional outline of the body of such a vehicle. Such vane members are rotatable from such sheltered positions thereof into operating positions similarly to the vane members provided on such described ships and they are similarly functionable to provide steering and heeling functions. Such vehicles may be provided with hydrofoil or airfoil means similarly occupying sheltered positions within the overall cross sectional outline of such vehicles which are also rotatable into operating positions.

Vane members according to the present invention may also be installed on rotary wing aircraft to facilitate the steering and banking thereof, and may further be utilized to replace the conventional rearwardly located empennage assembles of conventional airplanes provided with forwardly located wings.

As will be apparent from the foregoing summary, it is a general object of the present invention to provide novel and improved watercraft and other vehicles operable in a fluid medium.

Another object is to provide a novel and improved steering and stabilization apparatus for watercraft as well as vehicles operable in a fluid medium.

Still another object is to provide such ship structures as are described in the Parent Patents, as well as vehicles operable in a fluid medium, with improved steering, stabilization, and bank control apparatus.

DESCRIPTION OF THE PREFERRED EMBODIMENTS

Figure 1:
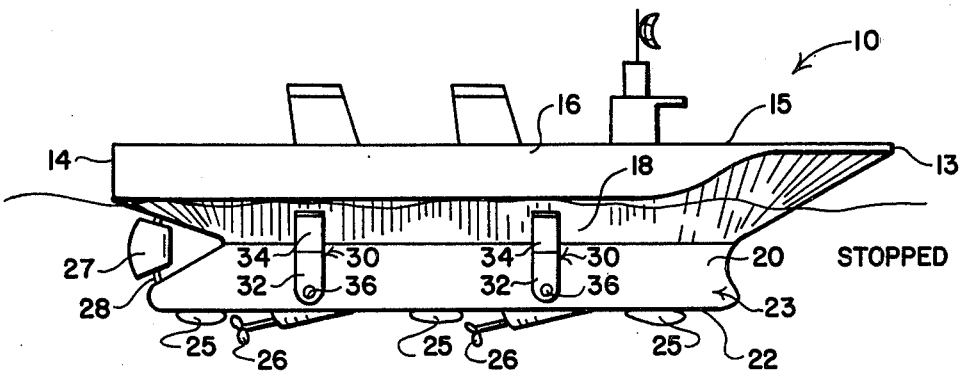
FIGS. 1 and 2 are side elevational views which show one embodiment of of a ship incorporating certain aspects of the present invention with the ship stopped and underway, respectively.

Referring to FIGS. 1–4, a semidisplacement hydrofoil ship is shown generally at 10. The hull of the ship 10 has starboard and port sides 11, 12 which converge at opposite ends to form a blunt but generally pointed bow 13 and a substantially planar transom 14 at the stern.

The hull of the ship 10 has a cross section which provides a stable deep-submergence vessel. The sides 11, 12 are each divided into upper, lower, and intermediate portions. The upper portions of the sides 11, 12 are widely spaced, substantially vertical freeboard portions 16, 17 which extend along opposite sides of a flat, substantially unobstructed deck 15. The lower portions of the sides 11, 12 are closely spaced, substantially vertical keel portions 20, 21 which are joined at the bottom by a keel surface 22. The keel surface 22 and the keel portions 20, 21 define a narrow base or submerged keel section 23 of the hull. The intermediate portions of the sides 11, 12 are inclined displacement and stabilizing portions 18, 19 which provide a transition between the keel and freeboard portions 20, 21 and 16, 17.

The spacing between the freeboard portions 16, 17 is preferably within the range of about 2 to 20 times the spacing between the keel portions 20, 21. A preferred relationship for large cargo ships has the keel portions 20, 21 spaced about one-third the distance between the freeboard portions 16, 17 at a majority of locations along the length of the hull.

A plurality of hydrofoils 25 are supported on the keel section 23. As is described in the referenced Parent Patents the hydrofoils 25 may be relatively closely spaced in fore and aft groups and extend from opposite sides of the lower portions 20, 21, or may be arranged in spaced relationship along any desired portion of the displacement keel 23. Power operated actuators are described in the Parent Patents for rotating the hydrofoils to control the lift, roll and pitch of the ship 10.

The ship 10 is provided with two tube-supported propellers 26 located in tandem along the bottom surface 22 of the keel section 23. The propellers 26 are preferably driven by separate turbojet engines carried in the keel section 23. Any desired number of propellers 26 can be mounted in tandem along the length of the keel section 23 as required to give the required propulsion force to the ship 10. Such tandem propellers are preferably each driven by a separate engine, but all may be driven from a common power plant.

Figure 2:
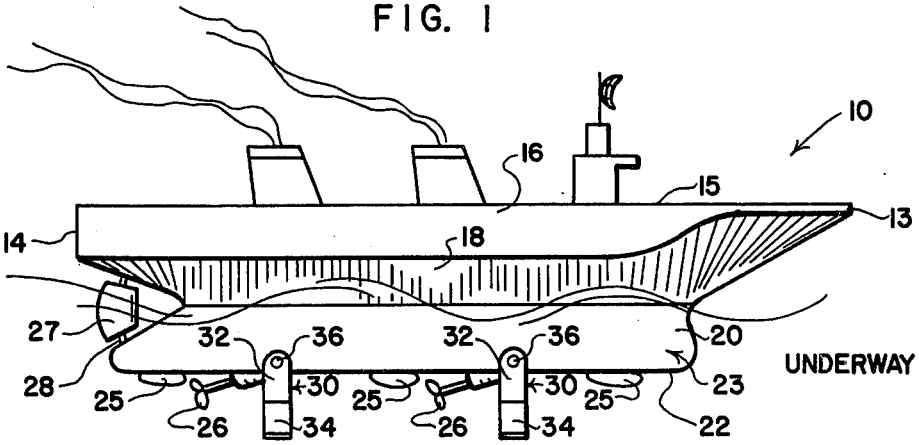

When the ship 10 is docked or otherwise at rest in the water, it is supported only by displacement forces. The displacement water line of the ship when at rest is ordinarily near the juncture of the freeboard and displacement portions 16, 18 and 17, 19 as shown in FIG. 1. When the ship 10 is underway, it is supported in part by the action of the hydrofoils, and the cruising water line is near the juncture of the keel and displacement portions 18, 20 and 19, 21 as shown in FIG. 2. Accordingly, only the keel section 23 of the hull is normally submerged when the ship is underway.

The ship 10 is provided with a rudder 27. A shaft 28 extends through the rudder 27 and has opposite ends journaled in the keel section 23 and in the transom 14.

As the ship 10 rises in the water during its transition from a displacement-supported mode to a displacement-and-hydrofoil-supported mode, the wetted surface area of the rudder 28 decreases. Such a decrease in wetted surface area is desirable because at higher speeds less rudder surface area is required to turn the ship 10.

In accordance with one feature of the present invention starboard and port vane members 30, 31 are respectively positioned on starboard and port sides of the ship 10. The vane members 30, 31 include mounting sections 32, 33 which extend alongside the lower hull portions 20, 21, and flared sections 34, 35 which flare outwardly from the mounting sections 32, 33.

Figure 8:
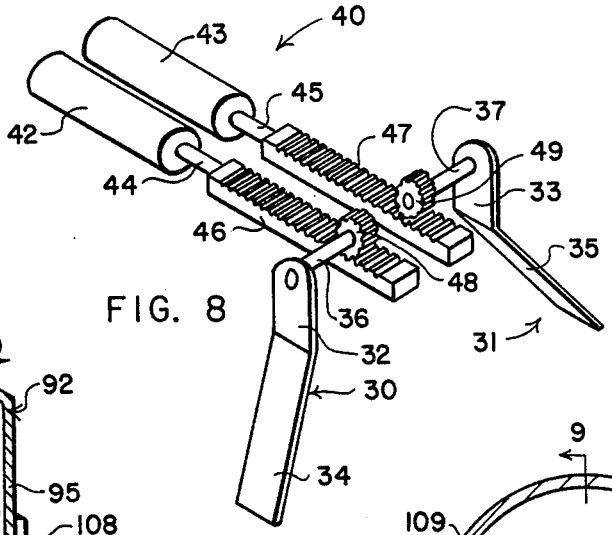
FIG. 8 is a perspective view of one drive mechanism embodiment for moving the vane members.

The vane members 30, 31 are movably mounted on the keel section 23. One drive mechanism embodiment that can be used to position the vane members 30, 31 is shown in FIG. 8. A pair of mounting shafts 36, 37 extend through and are journaled for rotation by the lower hull portions 20, 21. The shafts 36, 37 connect to the mounting sections 32, 33 to mount the vane members 30, 31 for rotation. The axes of the shafts 36, 37 are preferably substantially horizontal and extend transversely of the length of the ship 10.

Figure 3:
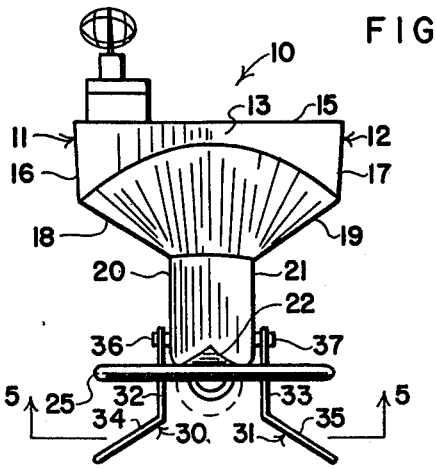
FIGS. 3 and 4 are bow elevational views of the ship of FIGS. 1 and 2 with vane members in operating and sheltered positions, respectively.
Figure 4:
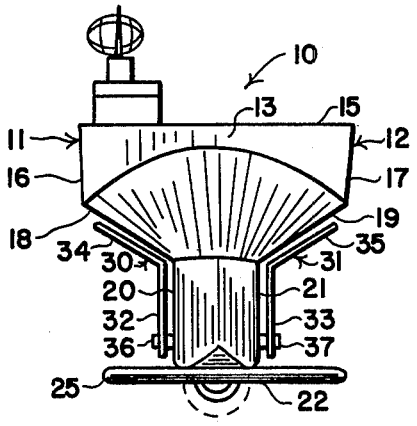

The drive mechanism 40 is housed within the displacement keel 23 and connects with the shafts 36, 37 to rotate the shafts and position the vane members 30, 31 between sheltered positions shown in FIGS. 1 and 4, and extended positions shown in FIGS. 2 and 3. The drive mechanism 40 includes a pair of conventional fluid actuated cylinders 42, 43. The cylinders 42, 43 have pistons 44, 45 which are extensible and retractible in response to a supply of pressurized fluid.

A pair of toothed gear racks 46, 47 are connected to the pistons 44, 45, respectively. A pair of gears 48, 49 are mounted on the shafts 36, 37. The gear racks 46, 47 drivingly engage the gears 48, 49 to rotate the gears 48, 49 in response to reciprocation of the gear racks 46, 47 by the pistons 46, 47. Pressurized fluid can be supplied to the cylinders 42, 43 by any of a variety of commerically available control mechanisms which need not be described.

The vane members 30, 31 can be used in combination with or in place of the rudder 27 to steer the ship 10. A steering function can be obtained by rotating the vane members 30, 31 in opposite directions regardless of whether the vane members 30, 31 are in their sheltered position (FIGS. 1 and 4) or their extended position (FIGS. 2 and 3).

Figure 5:
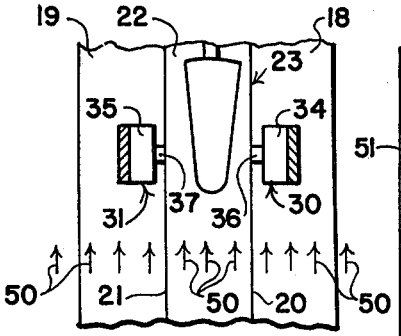
FIG. 5 is a cross-sectional view as seen from a plane indicated by a line 5—5 in FIG. 3.
Figure 6:
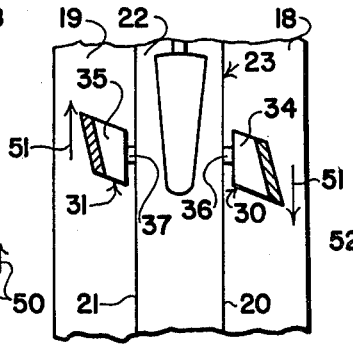
FIGS. 6 and 7 are cross-sectional views similar to FIG. 5 but with the vane members counter-rotated to steer the ship.
Figure 7:
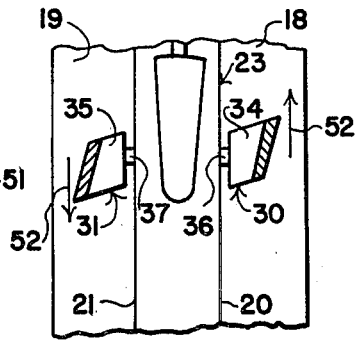

The manner in which the vane members 30, 31 operate to provide a steering function is illustrated in FIGS. 5–7. In FIGS. 5–7, the vane members 30, 31 are shown in cross section as seen from horizontal planes which parallel the bottom surface of the keel section 23, as indicated by the line 5—5 in FIG. 3.

Referring to FIG. 5, water flowing along the bottom of the ship 10 as the ship moves forwardly through a body water is indicated by arrows 50. With the vane members 30, 31 depending in parallel vertical fashion into the water below the ship 10, the cross sections of the vane members 30, 31 parallel the water flow indicated by the arrows 50. The vane members 30, 31 accordingly serve no turning function when positioned as shown in FIG. 5, but do serve to steer the ship 10 on a straight ahead course of movement.

Referring to FIGS. 6 and 7, if the shafts 36, 37 are counter-rotated as indicated either by arrows 51 or 52, it will be seen that the outboard surface of one of the flared sections 34, 35 and an inboard surface of the other of the flared sections 34, 35 is exposed to the water moving past the vane members 30, 31, and the vane members 30, 31 therefore serve to steer the ship 10 to port or starboard.

While FIGS. 5–7 illustrate the steering action and stabilization action which is effected by the vane members 30, 31 when the vane members are extended, it will be apparent that the same sort of steering action can be effected when the vane members 30, 31 are counter-rotated about their sheltered positions.

Still another function for which the vane members 30, 31 can be utilized is to control the roll of the ship 10. When the vane members 30, 31 are counter-rotated about either of their extended or sheltered positions, one of the flared sections 34, 35 will expose its upper surface to water flowing along the ship 10, while the other of the flared sections 34, 35 will expose its lower surface to the water flow. The vane members 30, 31 accordingly serve to bank the ship 10. This banking or heeling action is coordinated with the described steering action and facilitates stable turning maneuvers of the ship 10.

Still another function, namely, a braking action, can be achieved by the vane members 30, 31 by rotating the vane members to substantially horizontal positions where the flared portions 34, 35 oppose the flow of water passing along the ship 10.

An important function which is readily served by the vane members 30, 31 is that of stabilizing the ship 10. The large wetted area of the vane members 30, 31 helps stabilize the ship regardless of whether the ship 10 is stopped or underway. When the vane members 30, 31 are rotated to their extended positions, they depend deeply below the ship's hull into waters that are less affected by wave action and accordingly help stabilize the ship in heavy seas.

Still another function which can be served by the vane members 30, 31 is that of moving the ship at an angle of list as may be necessary where cross currents of large magnitude are encountered or where the ship's loading is substantially unsymmetrically balanced.

Any number of vane members 30, 31 can be provided along the length of the ship 10 as may be required to achieve the desired steering, stabilization or other function. A plurality of vane members can be supported in tandem bi-plane fashion on common shafts. The wetted surface area of the vane members 30, 31 is selected to provide adequate control surface areas to achieve the desired steering, stabilization or other function.

Figure 9:
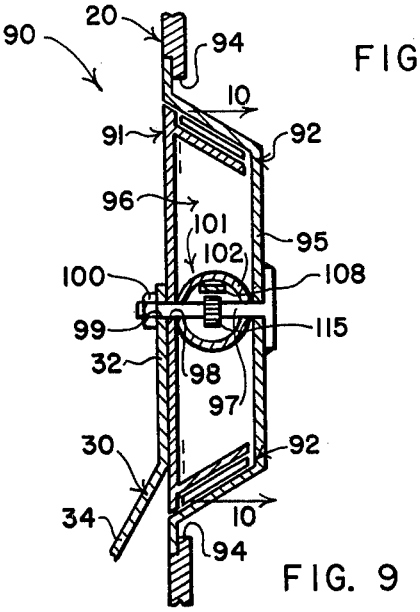
FIGS. 9 and 10 are sectional views of an alternate drive mechanism embodiment for moving the vane members.
Figure 10:
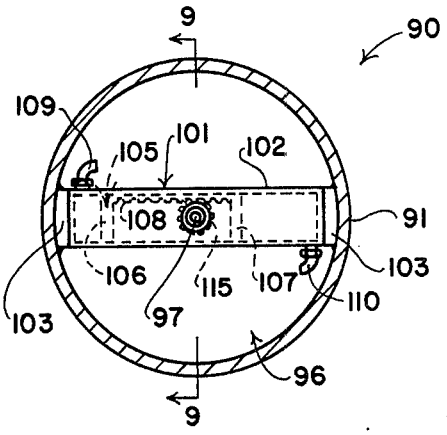

Referring to FIGS. 9 and 10, an alternate and preferred vane mounting and drive system embodiment is indicated by the numeral 90. The system 90 utilizes a disc structure 91 which mounts the inner end portion 32 of of one of the vanes 30. A large surface area, tapered, self-cleaning, water lubricated bearing 92 journals the periphery of the disc structure 91 in a cavity provided in the hull portion 20. Bearings of this type are commercially available for marine applications and need not be described.

Referring to FIG. 9, an opening 94 is formed through the hull portion 20. A mounting plate 95 extends through and closes the opening 94, and is rigidly secured to the hull portion 20 as by welding. An outwardly facing recessed cavity 96 is defined by the plate 95. A stub shaft 97 is rigidly carried by the plate 95 and extends centrally through the cavity 96.

A hole 98 is formed through the disc structure 91. An aligned hole 99 is formed throguh the vane portion 32. The stub shaft 97 extends through the holes 98, 99. A fastener 100 receives the outer end of the stub shaft 97 and holds the disc structure 91 in place in the recessed cavity 96.

A hydraulic actuator assembly 101 is supported inside the disc structure 91 for rotating the vane 30. Referring to FIG. 10, the actuator 101 is of a commercially available type and includes a hollow cylindrical housing 102. Opposite ends of the housing 102 are rigidly connected to the disc structure 91 by a pair of brackets 103.

A piston 105 is movably supported inside the housing 102. The piston 105 includes spaced end portions 106, 107 which slip-fit within the walls of the housing 102 and which carry conventional seals (not shown). A gear rack 108 interconnects the end portions 106, 107. Hydraulic lines 109, 110 connect with the housing 102 and communicate with opposite ends of the chamber defined inside the housing 102. The piston 105 moves inside this chamber in response to a supply of pressurized fluid through the hydraulic lines 109, 110.

A pinion 115 is rigidly connected to the stub shaft 97 and drivingly engages the gear rack 108. By this arrangement, when the piston 105 moves relative to the housing 102, the driving connection between the gear rack 108 and the pinion 115 forces the housing 102 to rotate relative to the stub shaft 97. The disc structure 91 and the vane 30 rotate with the housing 102.

The mounting and drive system embodiment 90 has several advantages over the embodiment 40. Principal among the advantages is that a large surface area bearing is provided to transmit forces from the vane 30 to the hull portion 20. An additional advantage is that the drive mechanism is compact and does not require space inside the hull. Moreover, the entire mechanism can easily be removed and replaced without exposing openings through the hull.

Figure 11:
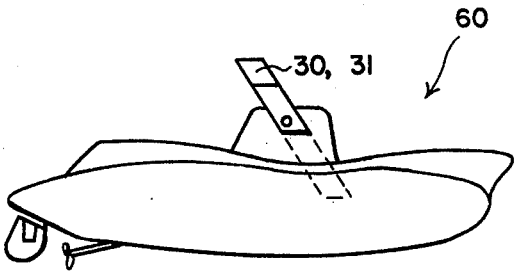
FIGS. 11, 12, and 13 are side elevational views of other ship embodiments employing vane members in accordance with other aspects of the present invention.
Figure 12:
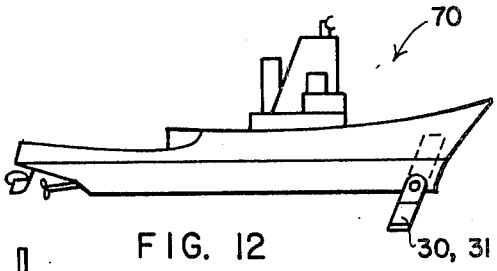
Figure 13:
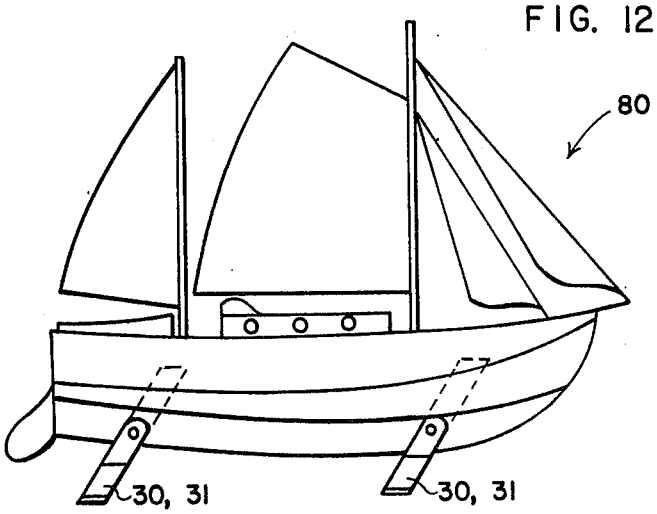

The usefulness of the vane members of the present invention is not confined to semi-displacement ships of the type described in the Parent Patents. Referring to FIGS. 11, 12 and 13, vane members 30, 31 are shown mounted on a submarine 60, a conventional displacement ship 70, and a sailing vessel 80. In each of the applications shown in FIGS. 11–13, the vane members 30, 31 have mounting sections which are movably secured to relatively closely spaced hull portions. The vane members 30, 31 are positionable in sheltered positions (shown in phantom) where the vane members have sections which lie along-side hull portions which are, at least in part, relatively widely spaced. The vane members 30, 31 are movable from such sheltered positions to extended positions where they extend away from such widely spaced hull portions.

The vane members 30, 31 shown in FIGS. 11 and 12 are of a swept-back design which, from a bow elevational view have the same appearance as the vane members 30, 31 shown in FIGS. 3, 4.

Where used on missle-carrying warships and the like, the vane members 30, 31 are very useful in stabilizing the ship to provide a stable launching platform that is less subject to reaction movements as missles are launched.

A significant advantage of the vane members 30, 31, regardless of the function they are selected to serve, is that they can be moved to sheltered positions when it is desirable to reduce the cross-sectional size of their ship. A further advantage is that the vane members 30, 31 can be used to steer or stabilize their ship regardless of whether they are in extended or sheltered positions. By this arrangement, the ship can operate in both shallow and deep waters.

Figure 14:
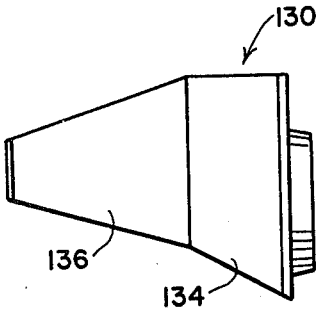
FIGS. 14, 16, 18, and 20 are top plan views of alternate vane embodiments.
Figure 15:
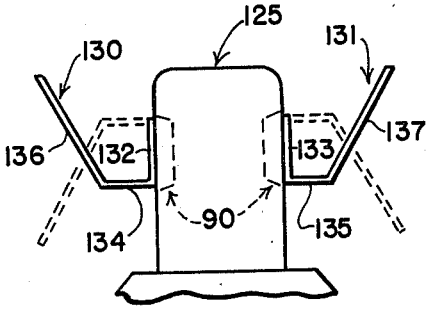
FIGS. 15, 17, 19, and 21 are end elevational views of the vane embodiments of FIGS. 14, 16, 18, and 20 mounted on the conning tower of a submarine.

Referring to FIGS. 14 and 15, vane members of another configuration are indicated by the numerals 130, 131. The vane members 130, 131 include mounting sections 132, 133 planing sections 134, 135, and flared sections 136, 137. The described mounting and drive system embodiment 90 is preferably used to mount the vane members 130, 131 on the conning tower of a submarine, as indicated by the numeral 125.

The vane members 130, 131 are rotatable between extended operating positions, shown in solid lines in FIG. 15, and sheltered operating positions shown in phantom. In the sheltered positions, the flared sections 136, 137 overlie the submarine's hull and provide a relatively low profile. When the vane members 130, 131 are rotated concurrently in the same direction, they operate as diving planes. When the vane members 130, 131 are counter-rotated they operate as described in conjunction with FIGS. 5–7 to provide steering and heeling functions. The vane members 130, 131 are preferably constructed such that drag forces impose on vane surface areas located above and below the axes of rotation of the vane members 130, 131 equalize and thereby tend to maintain the vane members 130, 131 in alignment with the flow stream of water.

Figure 16:
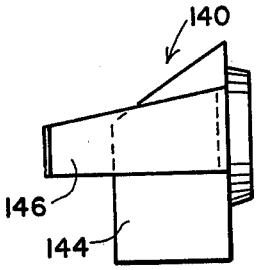
Figure 17:
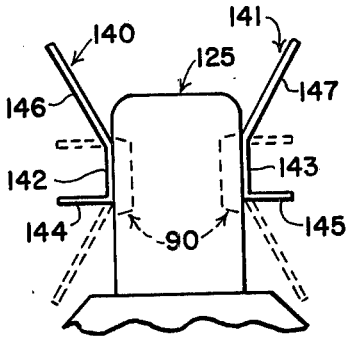

Referring to FIGS. 16 and 17, vane members of another configuration are indicated by the numerals 140, 141. The vane members 140, 141 include mounting sections 142, 143, planing sections 144, 145, and flared sections 146, 147. The described mounting and drive system embodiment 90 is preferably used to mount the vane members 140, 141 on the conning tower of a submarine, as indicated by the numeral 125.

The vane members 140, 141 are rotatable between extended operating positions, as shown in solid lines in FIG. 17, and sheltered operating positions shown in phantom. In the sheltered positions, the flared sections 146, 147 overlie the submarine's hull and provide a relative low profile. When the vane members 140, 141 are rotated concurrently in the same direction, they operate as diving planes. When the vane members 140, 141 are counter-rotated, they operate as described in conjunction with FIGS. 5–7 to provide steering and heeling functions. The vane members 140, 141 are preferably constructed such that drag forces imposed on vane surface areas located above and below the axes of the vane members 140, 141 equalize and thereby tend to maintain the vane members 140, 141 in alignment with the flow stream of water.

Figure 18:
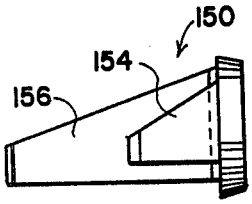
Figure 19:
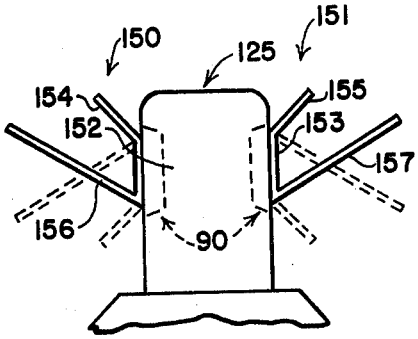

Referring to FIGS. 18 and 19, vane members of another configuration are indicated by the numerals 150, 151. The vane members 150, 151 include mounting sections 152, 153, short flaring sections 154, 155, and long flaring sections 156, 157. The described mounting and drive system embodiment 90 is preferably used to mount the vane members 150, 151 on the conning tower of a submarine, as indicated by the numeral 125.

The vane members 150, 151 are rotatable between extended operating positions, shown in solid lines in FIG. 19, and sheltered operating positions shown in phantom. In the sheltered positions, the flaring sections 154, 155, 156, 157 overlie the submarines hull and provide a relatively low profile. When the vane members 150, 151 are rotated concurrently in the same direction, they operate as diving planes. When the vane members 150, 151 are counter-rotated, they operate as described in conjunction with FIGS. 5–7 to provide steering and heeling functions. The vane members 150, 151 are preferably constructed such that drag forces imposed on vane surface areas located above and below the axes of rotation of the vane members 150, 151 equalize, and thereby tend to maintain the vane members 150, 151 in alignment with the flow stream of water.

Figure 20:
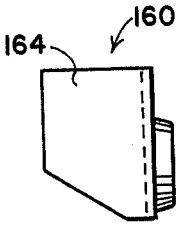
Figure 21:
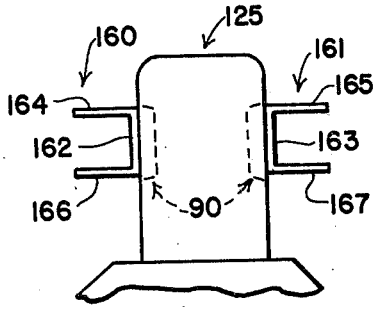

Referring to FIGS. 20 and 21, vane members of another configuration are indicated by the numerals 160, 161. The vane members 160, 161 include mounting sections 162, 163, and upper and lower planing sections 164, 165 and 166, 167. The described mounting and drive system embodiment 90 is preferably used to mount the vane members 160, 161 on the conning tower of a submarine, as indicated by the numeral 125.

While the vane members 160, 161 are rotatable, they do not, in the matter of the previously described vane members, move between extended and operating positions. When the vane members 160, 161 are rotated concurrently in the same direction, they operate as diving planes. When the vane members 160, 161 are counter-rotated, they provide a heeling function but to a less efficient degree than the previously described vane embodiments. The vane members 160, 161 are preferably constructed such that drag forces imposed on vane surface areas located above and below the axes of rotation of the vane members 160, 161 equalize and thereby tend to maintain the vane members 160, 161 in alignment with the flow stream of water.

Figure 22:
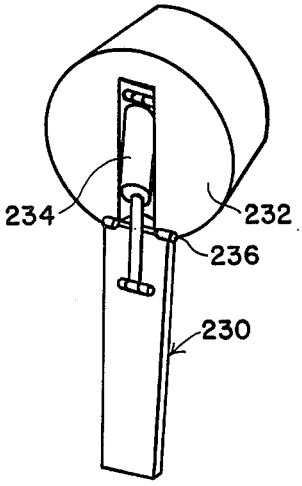
FIG. 22 is a perspective view of a folding vane embodiment.
Figure 23:
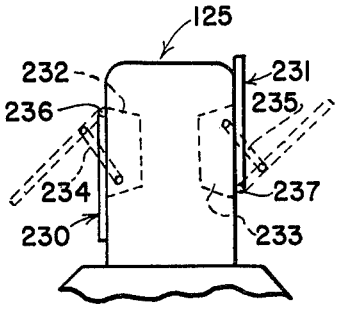
FIG. 23 is an end elevational view showing the vane of FIG. 22 mounted on the conning tower of a submarine.

Referring to FIGS. 22 and 23, folding vane members are indicated by the numerals 230, 231. The vane members 230, 231 can be mounted on such ship surfaces as the conning tower of a submarine, as indicated by the numeral 125. The vane members 230, 231 are preferably rotatably mounted as by a drive system embodiment of the type shown in FIGS. 9 and 10. Disc-shaped mounting members 232, 233 are journaled in tapered, self-cleaning, large surface area water lubricated bearings, as described. Hydraulic cylinders 234, 235 connect at one end with the disc structures 232, 233 and at the other end with the vane members 230, 231. Hinges 236, 237 pivotally connect the disc structures 232, 233 and the vane members 230, 231. By this arrangement, the vane members 230, 231 are movable between sheltered positions lying alongside the disc structures 232, 233, and such flaring positions as are shown in phantom in FIG. 23.

While the vane members 230, 231 are ordinarly both concurrently positioned in either upwardly or downwardly extending directions, the vane members 230, 231 as illustrated in FIG. 23 are shown one in a downwardly extending position and one in an upwardly extending position to illustrate the range of their movements. When the vane members 230, 231 are in flaring positions and are rotated together, they operate as diving planes. When the vane members 230, 231 are in flaring positions and are counter-rotated, they operate as described in conjunction with FIGS. 5–7 to provide steering and heeling functions.

Figure 24:
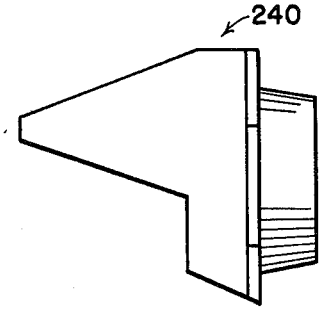
FIGS. 24 and 25 are top plan and end elevational views of an alternate folding vane embodiment.
Figure 25:
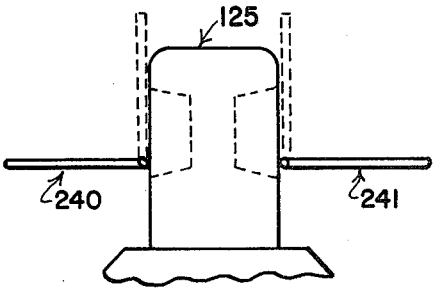

Referring to FIGS. 24 and 25, vane members of another configuration are indicated by the numerals 240, 241. The vane members 240, 241 are hingedly connected to disc structures in the manner of the vanes of FIGS. 22, 23. The vane members 240, 241 are movable between horizontally extended positions, as shown in solid lines in FIG. 25, and vertical sheltered positions as shown in phantom in FIG. 25. Moreover the vane members are positionable in flaring positions intermediate the extended and sheltered positions. When the vane members 240, 241 are in their horizontal extended positions, they may be rotated together and operate as diving planes. When the vane members are in flared positions, they may be rotated together to operate as diving planes or may be counter-rotated to provide a steering and heeling functions as described in conjunction with FIGS. 5–7.

The vane members 240, 241 are preferably constructed such that drag forces imposed on vane surface areas above and below their axes of rotation equalize when the vane members 240, 241 are folded and lie alongside their associated disc structures. By changing the proportion of vane member surface area near inner and outer ends of the vane members, they can be made to force-balance at selected flaring angles instead of in their fully folded positions.

Figure 26:
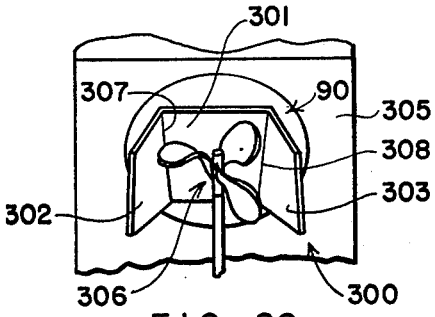
FIG. 26 is a perspective view of an alternate steering and stabilization device.

Referring to FIG. 26, still another steering and stabilization vane structure embodiment is indicated generally by the numeral 300. The vane structure 300 includes a mounting section 301 and a pair of flaring portions 302, 303 that depend obliquely from the mounting section 301. The described mounting and drive system embodiment 90 is preferably used to movably mount the vane structure 300 on the underside of a hull 305.

The vane structure 300 can be mounted above a ship's propeller 306 with the depending flaring portions 302, 303 on opposite sides of the propellor 306, as shown in FIG. 26. Alternatively, the vane structure can be mounted rearwardly of a ship's propellor. Regardless of its mounting position, the depending flaring portions operate to provide steering and heeling functions much in the manner illustrated in FIGS. 5–7. A disadvantage of this vane embodiment as compared with many of the foregoing embodiments is that the flaring portions 302, 303 are not movable to sheltered positions.

Figure 27:
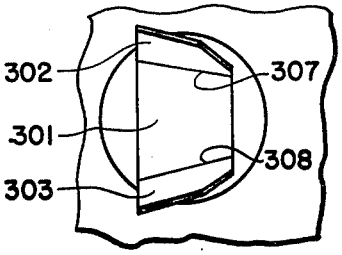
FIGS. 27 and 28 are bottom plan views showing modified forms of the device of FIG. 26.
Figure 28:
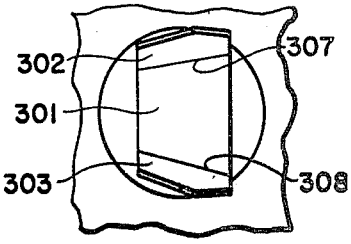
Figure 29:
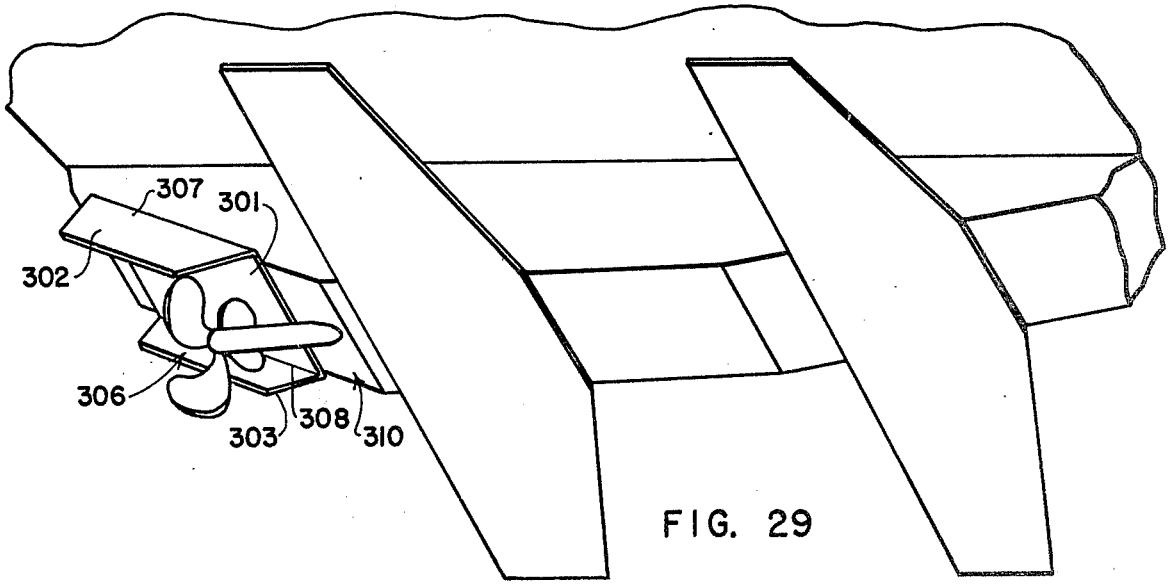
FIG. 29 is a perspective view of an alternate embodiment of the device of FIG. 26.

The flaring portions 302, 303 join the mounting section 301 along lines of juncture 307, 308. The lines of juncture 307, 308 can converge or diverge as illustrated in FIGS. 27 and 28, or can be parallel as shown in FIG. 29. The vane structure 300 can be mounted on a substantially horizontal hull portion 301, as shown in FIG. 26, or can be mounted on an inclined hull portion 310 as shown in FIG. 29.

Figure 30:
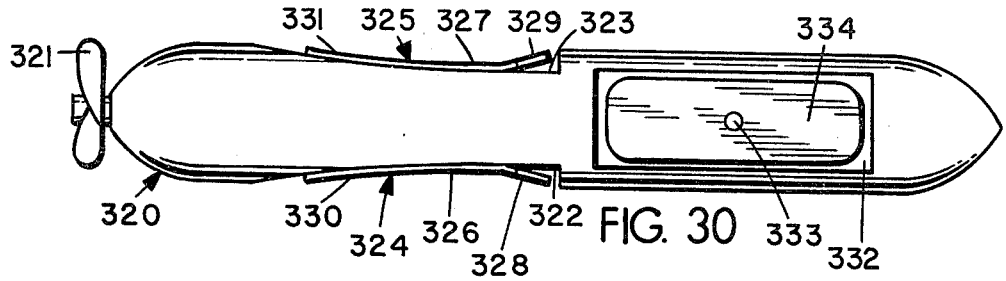
FIG. 30 is a top plan view of a torpedo employing vane members according to another aspect of the present invention as well as a hydrofoil disposed in their sheltered positions.
Figure 31:
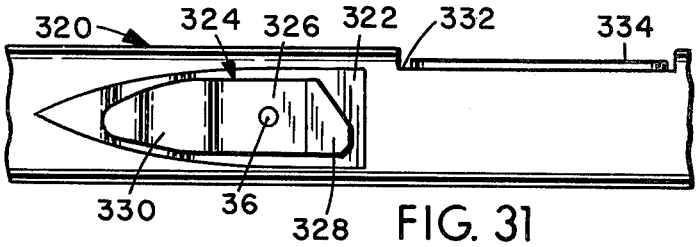
FIG. 31 is a partial side elevational view of the torpedo shown in FIG. 30.
Figure 32:
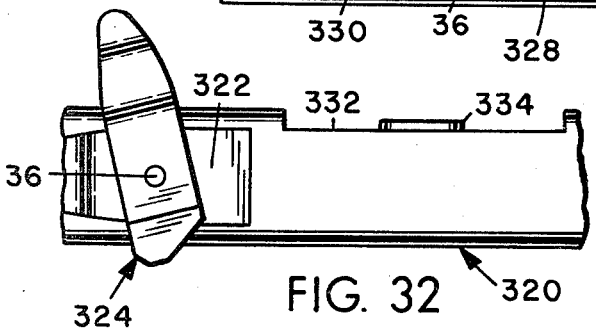
FIG. 32 is another partial side elevational view of the torpedo shown in FIG. 30 with the vane members and hydrofoil in operating positions.

Referring now to FIGS. 30–32, a torpedo operable completely submerged in water is shown generally at 320. The body of torpedo 320 is generally cylindrical in form, although including a rounded bow portion coming substantially to a point as well as a generally rounded stern portion from which a shaft carrying the propulsion screw 321 rearwardly extends.

Torpedo 320 is provided on opposite sides of the cylindrical portion of the body thereof with recesses 322, 323 formed therein, which commence at about the midships section thereof and extend rearwardly therefrom. A forward portion of each of such recesses 322, 323 includes a substantially planar, substantially operationally vertically extending surface having a longitudinal centerline substantially parallel to the longitudinal centerline of the torpedo 320. Each of such recesses 322, 323 includes a rearward portion of about twice the length of the forward portion thereof which gradually curves outwardly from the forward portion thereof towards the adjacent side of the body of torpedo 320.

Vane members, generally designated 324, 325, are mounted in recesses 322, 323, respectively. The vane members 324, 325 include substantially operationally vertically situated mounting sections 326, 327 which extend along the forward portions of the recesses 322, 323, respectively; forward short outwardly flared sections 328, 329, respectively; and rearward gradually curving long outwardly flared sections 330, 331, respectively.

The vane members 324, 325 are movably mounted on the torpedo 320 to rotate about an operationally substantially horizontally disposed axis situated adjacent the rearwardmost portions of the mounting sections 326, 327 thereof. The drive mechanism 40 shown in FIG. 8 of the drawings and described hereinbefore may be effectively utilized to move the vane members 324, 325; the shafts 36 and 37 of such drive mechanism 40 being connected to the vane members 324, 325, respectively.

It is to be especially noted that the outward flare of the forward short sections 328, 329 and the rearward long sections 330, 331 of the vane members 324, 325, respectively, is very slight, and that when such vane members 324, 325 are disposed in their sheltered positions within the described recesses, with the longitudinal axes of such vane members 324, 325 substantially paralleling the longitudinal axis of torpedo 320, as shown in FIGS. 30 and 31, no portion of such vane members 324, 325 extends beyond the overall circular cross-sectional outline of such torpedo 320.

Torpedo 320 is further provided with another recess 332 formed in the top of the cylindrical portion of the body thereof forwardly of the recesses 322, 323 formed therein; such recess 332 including a substantially planar, substantially operationally horizontally extending surface having a longitudinal centerline substantially parallel to the longitudinal centerline of the torpedo 320. A rotatable shaft 333 extends upwardly from the interior of the body of the torpedo 32 centrally into such recess 332, and an elongated hydrofoil 334 which is substantially rectangular in planform is centrally connected to such shaft 333; the lower surface of such hydrofoil 334 lying substantially adjacent such surface of the recess 332. The hydrofoil 334 is so proportioned that when the same is in its sheltered position with its longitudinal centerline substantially parallel to the longitudinal centerline of the torpedo 320, no portion thereof extends beyond the overall circular cross-sectional outline of the body of the torpedo 320. Suitable conventional means are provided within the body of the torpedo 320 to rotate the shaft 333 carrying hydrofoil 334, and no further description thereof herein is deemed necessary.

When the vane members 324, 325, as well as the hydrofoil 334, of torpedo 320 are in their sheltered positions as hereinbefore set forth, the torpedo 320 may be placed in a tubular launcher carried by a marine vessel or an aircraft which has a cylindrical inner wall of the same diameter or slightly larger than the cylindrical outer wall of the body of such torpedo 320. When the torpedo 320 has been launched, conventional means may be utilized to actuate the drive mechanism 40 for the vane members 324, 325, and to also rotate the shaft 333, for extending such vane members 324, 325, as well as such hydrofoil 334, to their operating positions as shown in FIG. 32. In its operating position the hydrofoil 334, with its longitudinal axis extending at right angles to the longitudinal axis of the torpedo 320, provides sustentation for the torpedo 320, while the vane members 324, 325, with the long curvilinearly flared sections 330, 331 thereof projecting more or less operationally vertically upwardly, are operable to provide roll and bank control, as well as pitch control, for the torpedo 320, similarly to the function of the vane members 30, 31 provided on the ship 10. As illustrated in FIG. 32, both of such vane members 324, 325 have been concurrently rotated somewhat rearwardly to drive the torpedo 320 deeper into the water, and they may be similarly be concurrently rotated forwardly to drive the torpedo 320 upwardly towards the surface of the water. Such vane members 324, 325 may also be counter-rotated to sheer and concurrently bank the torpedo 320 as it moves forwardly through the water.

Referring to FIGS. 33-37, an aerial missile operable in the atmosphere is shown generally at 350. The body of missile 350 is also generally cylindrical in form, although including a rounded forward portion coming substantially to a point. The blunt rearward end of the missile 350 includes the jet exit 351.

Missile 350 is provided on opposite sides of the cylindrical portion of the body thereof with recesses 352, 353 formed therein which commence at a point somewhat rearwardly of the longitudinal midpoint of the length thereof and which extend rearwardly to the blunt rearward end thereof. Each of such recesses 352, 353 includes a substantially planar surface having a longitudinal centerline substantially parallel to the longitudinal centerline of the missile 350, and each of which extends from a line adjacent the bottom of the missile 350 upwardly towards a line positioned somewhat above the mid-height line of the sides of the missile 350. Although each of such surfaces are operationally sloped at an angle of about 25° from the vertical, they may still be referred to as "operationally substantially vertically" disposed. Such surfaces of the recesses 352, 353 have their lower edges spaced apart a distance about equal to one-fifth of the diameter of the cylindrical body portion of the missile 350.

Vane members, generally designated 354, 355 are mounted in the recesses 352, 353, respectively. The vane members 354, 355 include elongated, rectangularly shaped mounting sections 356, 357, respectively, having planar inner surfaces positionable against such planar surfaces of the recesses 352, 353, respectively. Vane members 354, 355 further include forward short outwardly flared sections 358, 359, respectively, as well as rearward short outwardly flared sections 360, 361, respectively.

Each of the vane members 354, 355 are movably mounted on the missile 350 to rotate about an axis perpendicularly disposed with respect to such planar surface of each of the associated recesses 352, 353, respectively, which is situated substantially adjacent the rearwardmost end of mounting sections 356, 357 of such vane members 354, 355, respectively. A drive mechanism such as the drive mechanism 40 shown in FIG. 8 and hereinbefore described may be utilized to move the vane members 354, 355; the shafts 36 and 37 of such drive mechanism 40 being connected to the vane members 354, 355, respectively.

Figure 33:
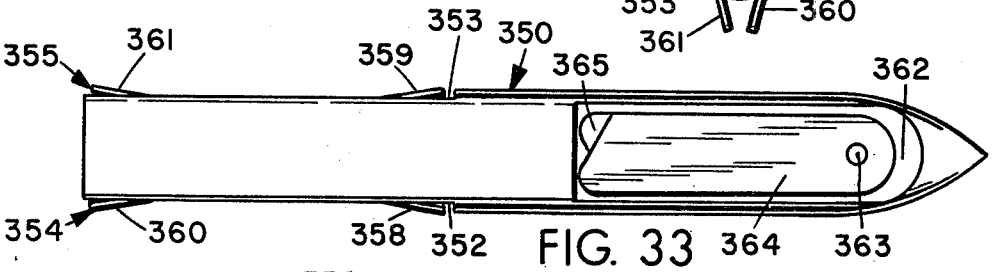
FIG. 33 is a top plan view of an aerial missile employing vane members according to yet another aspect of the present invention as well as airfoils disposed in their sheltered positions.
Figure 34:
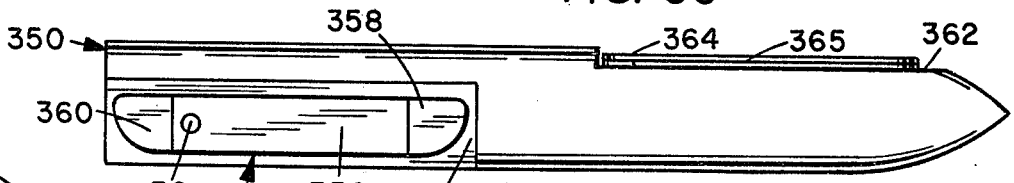
FIG. 34 is a side elevational view of the aerial missile shown in FIG. 33.

Again, it is to be particularly noted that the outward flare of the forward short sections 358, 359 of the vane members 354, 355, respectively, as well as the outward flare of the rearward short sections 360, 361 of vane members 354, 355, respectively, is very slight, and that when the vane members 354, 355 are disposed within their sheltered positions within the described recesses, with the longitudinal axes of such vane members 354, 355 substantially parallel to the longitudinal axis of missile 350, as shown in FIGS. 33 and 34, no portion of such vane members 354, 355 extends beyond the overall circular cross-sectional outline of such missile 350.

The missile 350 is further provided with another recess 362 formed in the top of the body thereof forwardly of the recesses 352, 353 formed therein; such recess 362 including a substantially planar, substantially operationally horizontally extending surface having a longitudinal centerline substantially parallel to the longitudinal centerline of the missile 350. A rotatable shaft 363 extends upwardly from the interior of the body of missile 350 into such recess 362 on the longitudinal centerline thereof adjacent the forward end thereof, and an elongated airfoil 364 which is generally rectangular in planform is connected adjacent one end thereof on the longitudinal centerline thereof to such shaft 363. Another shaft, not illustrated, which is of tubular construction and operationally surrounds shaft 363, is similarly connected to another airfoil 365, which in planform is a mirror image of airfoil 364, and which is adapted to underlie airfoil 364. The lower surface of airfoil 365 is adapted to lie substantially adjacent the described surface of the recess 362, and the lower surface of airfoil 364 is adapted to lie substantially adjacent the upper surface of airfoil 365. The airfoils 364 and 365 are so proportioned that when the same are disposed in their sheltered positions, with their longitudinal centerlines extending parallelly rearwardly and parallel to the longitudinal centerline of missile 350, no portion of such airfoils 364 and 365 extends beyond the overall circular cross-sectional outline of the body of missile 350. Suitable conventional means are provided within the body of missile 350 to counter-rotate the shaft 363 connected to airfoil 364 and the tubular shaft surrounding the same connected to airfoil 365, and no further description thereof is deemed necessary herein.

Figure 37:
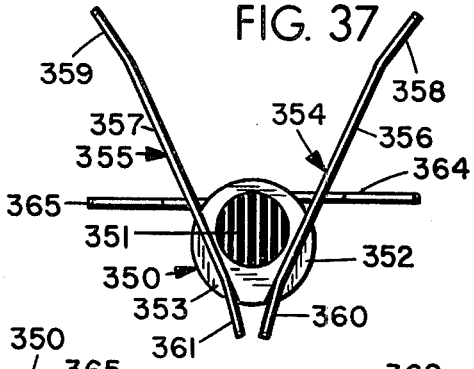
FIG. 37 is a rear elevational view of the aerial missile of FIG. 33 with the airfoils and vane members thereof in operating positions.
Figure 36:
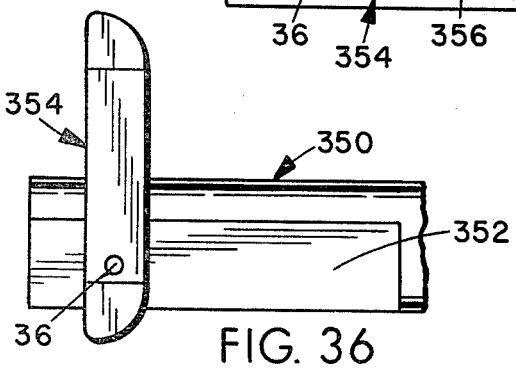
FIG. 36 is a partial side elevational view of the aerial missile of FIG. 33 with the vane members thereof in operating positions.
Figure 35:
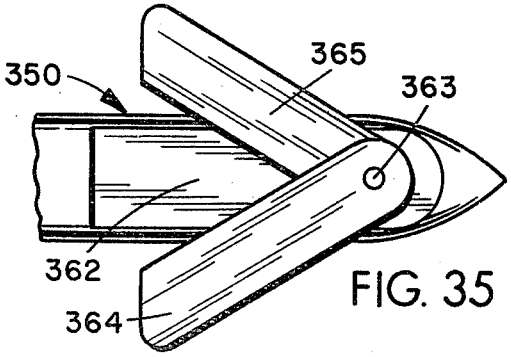
FIG. 35 is a partial top plan view of the aerial missile of FIG. 33 with the airfoils thereof in operating positions.

When the vane members 354, 355, as well as the airfoils 364 and 365, of missile 350 are in their sheltered positions as hereinbefore set forth, and as illustrated in FIGS. 33 and 34, the missile 350 may be placed in a tubular launcher carried by a marine vessel or an aircraft which has a cylindrical inner wall of the same diameter or slightly larger than the cylindrical outer wall of the body of such missile 350. When the missile 350 has been launched, conventional means may be utilized to actuate the drive mechanism 40 for the vane members 354, 355, and to counter-rotate the shafts connected to the airfoils 364 and 365, for extending the vane members 354, 355 into their operating position, as shown in FIGS. 36 and 37, as well as for extending the airfoils 364 and 365 into their operating positions, as shown in FIGS. 35 and 37. In their operating positions, airfoil 364 extends from the right side of missile 350 at about a 60° sweep angle, while airfoil 365 extends from the left side of missile 350 at the same sweep angle. Airfoils 364 and 365 operationally coact to provide sustentation for missile 350. The vane members 354, 355, with the elongated sections 356, 357 thereof, respectively, operationally projecting substantially vertically upwardly, are operable to provide roll and bank control for missile 350 when counter-rotated, and are also operable to provide pitch control for missile 350 when concurrently rotated rearwardly or forwardly, functioning similarly to the vane members 324, 325 provided on torpedo 320, as set forth hereinbefore.

Figure 38:
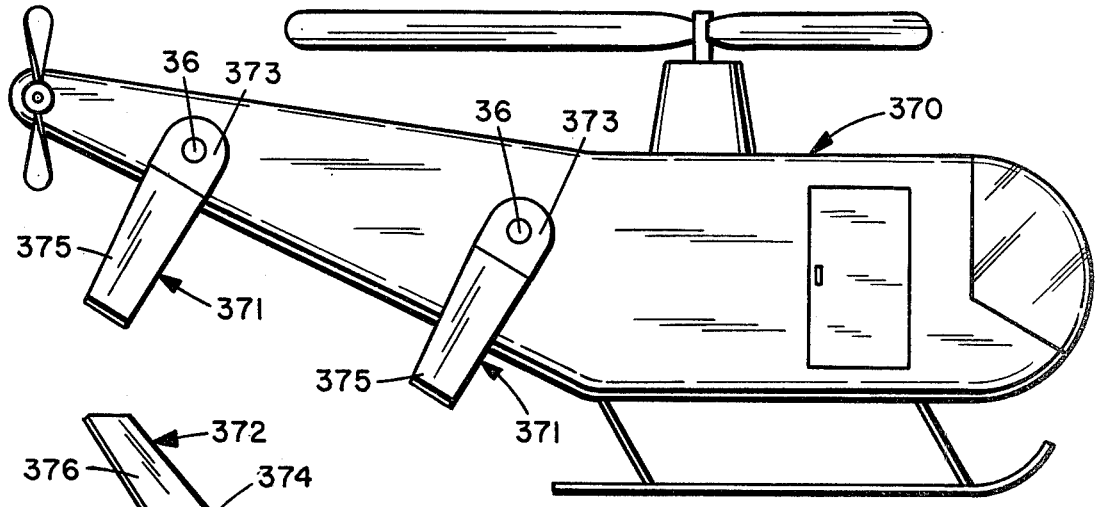
FIG. 38 is a side elevational view of a rotary wing aircraft employing vane members according to still another aspect of the present invention.
Figure 39:
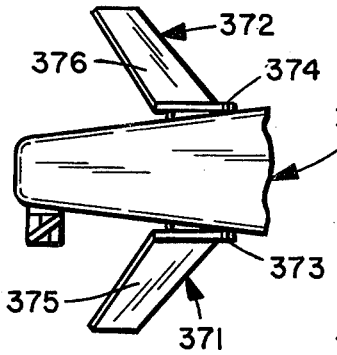
FIG. 39 is a partial top plan view of the aircraft of FIG. 38 showing a pair of the vane members employed therewith.
Figure 40:
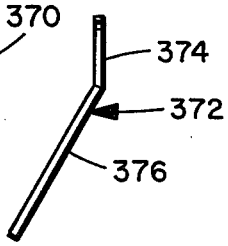
FIG. 40 is a rear elevational view of one of the vane members employed with the aircraft of FIG. 38.

Referring now to FIGS. 38–40, a rotary wing aircraft is shown generally at 370. Aircraft 370 is provided on opposite sides of the body thereof with vane members, generally designated 371, 372. The vane members 371, 372 include mounting sections 373, 374, respectively, which extend substantially alongside the body of aircraft 370, and further include flared sections 375, 376, respectively, which flare outwardly from the mounting sections 373, 374 thereof, respectively, and which are operationally substantially downwardly directed. The vane members 371, 372 are movably mounted on the body of aircraft 370 to rotate about axes perpendicular to the plane of symmetry of the body of aircraft 370. A drive mechanism such as the drive mechanism 40 shown in FIG. 8 and hereinbefore described may be utilized to move the vane members 371, 372; the shaft 36 of such a drive mechanism being centrally connected to the mounting section 373 of a vane member 371 and the shaft 37 of such a drive mechanism 40 being centrally connected to the mounting section 374 of an associated vane member 372.

Although a forward pair of vane members 371, 372, as well as a rearward pair of vane members 371, 372 are shown carried by aircraft 370 in FIG. 38, it will be apparent that this tandem arrangement of two pairs of such vane members 371, 372 may be modified. For example, only one pair of vane members 371, 372 may be provided on an aircraft 370, or, alternatively, more than two pairs of such vane members 371, 372 may be carried by an aircraft 370.

The vane members 371, 372 operate to provide control functions for the aircraft 370 similarly to the control functions provided by the operation of the vane members 30, 31 mounted on the ship 10, and no further description thereof is deemed necessary herein.

Figure 41:
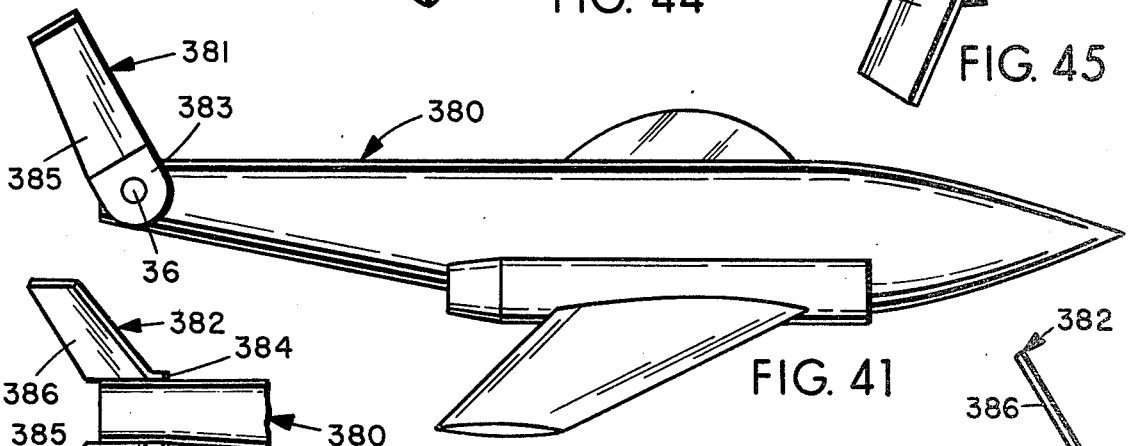
FIG. 41 is a side elevational view of an airplane employing vane members according to still a further aspect of the present invention in lieu of a conventional rearwardly positioned empennage assembly.
Figure 42:
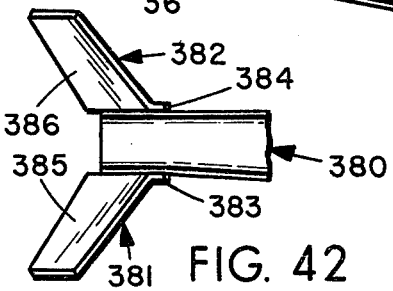
FIG. 42 is a partial top plan view of the airplane of FIG. 41 showing the vane members employed therewith.
Figure 43:
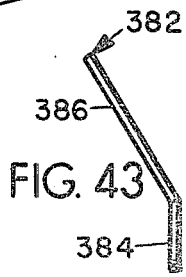
FIG. 43 is a rear elevational view of one of the vane members employed with the airplane of FIG. 41.

Referring to FIGS. 41–43, an airplane having a forwardly positioned wing is shown generally at 380. Airplane 380, in lieu of a conventional rearwardly positioned empennage assembly, is provided on opposite sides of the body thereof at a rearward location with vane members, generally designated 381, 382. The vane members 381, 382 include mounting sections 383, 384, respectively, which extend substantially alongside the body of airplane 380, and also include flared sections 385, 386, respectively, which flare outwardly from the mounting sections 383, 384 thereof, respectively, and which are operationally substantially upwardly directed. The vane members 381, 382 are movably mounted on the body of airplane 380 to rotate about an axis perpendicular to the plane of symmetry thereof. Again, a drive mechanism such as the drive mechanism 40 shown in FIG. 8 and described hereinbefore may be utilized to move the vane members 381, 382; the shaft 36 of the drive mechanism 40 being centrally connected to the mounting section 383 of the vane member 381 and the shaft 37 of the drive mechanism 40 being centrally connected to the mounting section 384 of the vane member 382.

The vane members 381, 382 operate to provide control functions for the airplane 380 similarly to the control functions provided by the operation of the vane members 324, 325 mounted on torpedo 320, and accordingly the specific operation thereof will not be further described herein.

Figure 44:
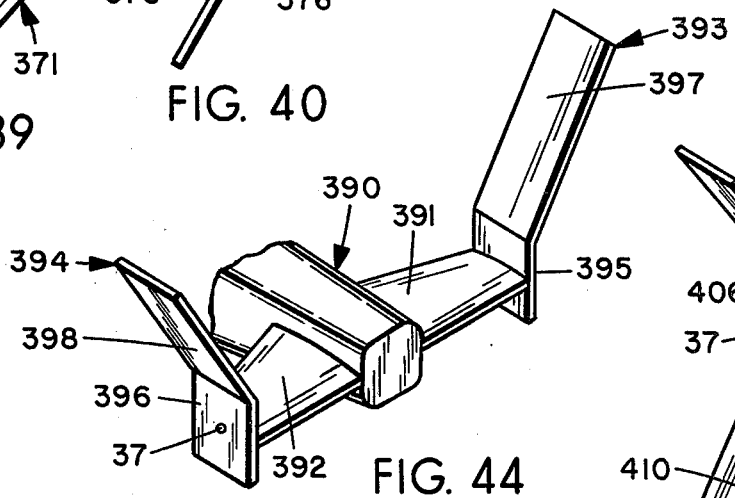
FIG. 44 is a perspective view of an alternate empennage assembly for an airplane employing vane members according to yet a further aspect of the present invention; and, FIG. 45 is a partial perspective view of yet another empennage assembly for an airplane employing an alternative embodiment of the vane members according to the present invention.

In FIG. 44, a rearward portion of the body of an airplane generally similar to airplane 380 is shown generally at 390. Airplane 390 includes, however, horizontal stabilizers 391, 392 located at the rearward end of the body thereof. In lieu of conventional rudder carrying vertical stabilizer means airplane 390 is provided at the outboard ends of the horizontal stabilizers 391, 392 with vane members, generally designated 393, 394, respectively. The vane members 393, 394 include mounting sections 395, 396, respectively, which extend alongside the outboard ends of such horizontal stabilizers, and further include flared sections 397, 398, which flare outwardly from the mounting sections 395, 396 thereof, respectively, and which are operationally substantially upwardly directed. The vane members 393, 394 are rotatable about an axis perpendicular to the plane of symmetry of the airplane 390. In this case, also, a drive mechanism such as the drive mechanism 40 shown in FIG. 8 and described hereinbefore may be utilized to move the vane members 393, 394; the shaft 36 of the drive mechanism 40 extending outwardly from the body of airplane 390 through horizontal stabilizer 391 and being centrally connected to the mounting section 395 of the vane member 393 and the shaft member 37 of the drive mechanism 40 extending outwardly from the body of airplane 390 through horizontal stabilizer 392 and being centrally connected to the mounting section 396 of the vane member 394.

The vane members 393, 394 of airplane 390 operate in the same manner to provide the same results as the vane members 381, 382 of airplane 380.

Figure 45:
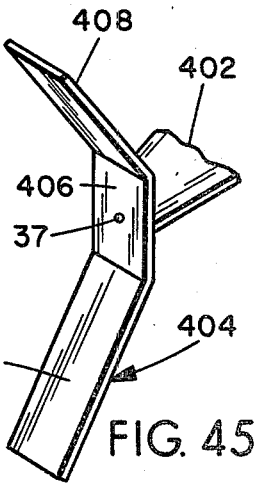

In FIG. 45, there is shown a horizontal stabilizer 402 carried by an airplane similar to airplane 390. The outboard end of the horizontal stabilizer 402 carries a vane member, generally designated 404, having a mounting section 406 and flared sections 408, 410 which flare outwardly from mounting section 406 and which are operationally substantially upwardly and substantially downwardly directed, respectively. The vane member 404 differs from the vane member 394 only in including the additional flared section 410. The vane member 404 is mounted on the horizontal stabilizer 402 similarly to the mounting of the vane member 394 on the horizontal stabilizer 392, and is similarly rotated by a similar drive mechanism. The vane member 404 functions similarly to the vane member 394, and may be utilezed on airplane 390 in lieu thereof. Of course, a mirror image horizontal stabilizer and vane member arrangement would be provided on the other side of any airplane utilizing such a vane member 404 carried by such a horizontal stabilizer 402.

The vane members 381, 382 carried by airplane 380, the vane members 393, 394 carried by the airplane 390, and vane members such as the vane member 404 carried by an airplane 390 or by another airplane similar thereto, all may be rotated to positions in which the height thereof above a surface upon which the airplanes carrying the same are parked is a minimum. Accordingly, carrier based naval aircraft could be especially advantageously provided with the same in lieu of conventional empennage assemblies, for the reason that the overhead clearance presently provided on the hangar decks of naval aircraft carriers, which is presently necessarily sufficient to accomodate the high empennage assemblies of conventional airplanes, could be materially reduced, leading to significant savings in construction and other costs.

Obviously, other variations and modifications of the present invention are possible in the light of the foregoing teachings. It is therefore to be understood that within the scope of the appended claims the invention may be practiced otherwise than as specifically described.

What is claimed is:

1. An airplane, comprising:

an elongated fuselage carrying substantially forwardly positioned airfoil means capable of providing lift forces for sustaining said airplane in flight;

a pair of elongated vane members positioned alongside said fuselage adjacent the rearward end thereof having substantially planar outer end regions projecting away from said fuselage and having inner end regions nearer said fuselage than said outer end regions thereof; and mounting means mounting said inner end regions on said fuselage for rotary movement about a substantially horizontal common axis substantially perpendicularly disposed with respect to the plane of symmetry of said airplane;

said substantially planar outer end region of each of said vane members extending in a plane which obliquely intersects said common axis, each of said vane members being rotatable about said common axis and thereby rotatably movable into and out of alignment with the airstream passing rearwardly alongside said fuselage when said airplane is moving forwardly to concurrently serve steering and banking functions.

2. The airplane of claim 1 additionally including drive means for, in one mode of operation, moving the vane members concurrently in opposite directions of rotation, and, in another mode, for moving the vane members in the same direction of rotation.

3. An airplane, comprising:

an elongated fuselage carrying horizontal stabilizers;

a pair of elongated vane members positioned at the outer ends of said horizontal stabilizers having substantially planar outer end regions projecting away from said horizontal stabilizers and having inner end regions nearer said fuselage than said outer end regions thereof; and mounting means mounting said inner end regions on said horizontal stabilizers for rotary movement about a substantially horizontal common axis substantially perpendicularly disposed with respect to the plane of symmetry of said airplane;

said substantially planar outer end region of each of said vane members extending in a plane which obliquely intersects said common axis, each of said vane members being rotatable about said common axis and thereby rotatably movable into and out of alignment with the airstream passing rearwardly alongside said fuselage and said horizontal stabilizers when said airplane is moving forwardly to concurrently serve steering and banking functions.

4. The airplane of claim 3 additionally including drive means for, in one mode of operation, moving the vane members concurrently in opposite directions of rotation, and, in another mode, for moving the vane members concurrently in the same direction of rotation.

* * * * *